US010597871B2

(12) United States Patent
Recker et al.

(10) Patent No.: US 10,597,871 B2
(45) **Date of Patent: *Mar. 24, 2020**

(54) LIFTING AND LEVELING INSERT FOR A PRECAST CONCRETE SLAB

(71) Applicant: Meadow Burke, LLC, Riverview, FL (US)

(72) Inventors: Michael J. Recker, Palmetto, FL (US); Ronald G. Naumann, Valrico, FL (US); Hector G. Ruiz, Fort Worth, TX (US)

(73) Assignee: Meadow Burke, LLC, Riverview, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/430,171

(22) Filed: Jun. 3, 2019

(65) Prior Publication Data

US 2019/0284803 A1 Sep. 19, 2019

Related U.S. Application Data

(63) Continuation of application No. 15/994,087, filed on May 31, 2018, now Pat. No. 10,309,103, which is a (Continued)

(51) Int. Cl.
*E04B 5/04* (2006.01)
*E04B 5/17* (2006.01)
(Continued)

(52) U.S. Cl.
CPC ..... *E04B 5/04* (2013.01); *E01C 5/001* (2013.01); *E01C 19/00* (2013.01); *E01C 23/10* (2013.01);
(Continued)

(58) Field of Classification Search
CPC .... E04B 1/3511; E04B 1/4121; E04B 1/4157; E04C 23/10; E04C 19/52; E04G 21/142; B28B 23/005
See application file for complete search history.

(56) References Cited

U.S. PATENT DOCUMENTS 991,517 A 5/1911 Kennedy
1,185,765 A 6/1916 Brooks
(Continued)

FOREIGN PATENT DOCUMENTS

DE 9421091 4/1995
JP 10037109 2/1998
(Continued)

OTHER PUBLICATIONS

U.S. Appl. No. 29/649,563, filed May 31, 2018, Recker.
(Continued)

*Primary Examiner* — Christine T Cajilig
(74) *Attorney, Agent, or Firm* — Sheridan Ross P.C.

(57) ABSTRACT

An insert for lifting and leveling a precast concrete slab is provided. The insert includes a sleeve that extends through the concrete slab and has two distinct threaded portions on an inner surface of the sleeve. This configuration allows a lifting bolt to be positioned into an upper end of the sleeve to lift the concrete slab, and a different-sized leveling bolt to be positioned in the sleeve to selectively elevate or raise part of the concrete slab relative to a ground surface.

20 Claims, 10 Drawing Sheets

Related U.S. Application Data continuation-in-part of application No. 15/656,486, filed on Jul. 21, 2017, now Pat. No. 10,100,515.

(60) Provisional application No. 62/365,271, filed on Jul. 21, 2016.

(51) Int. Cl.

| | |
|---|---|
| ***E01C 23/10*** | (2006.01) |
| ***E01C 5/00*** | (2006.01) |
| ***E01C 19/00*** | (2006.01) |

(52) U.S. Cl.

CPC ..... *E04B 2005/176* (2013.01); *E04B 2103/02* (2013.01)

(56) References Cited

U.S. PATENT DOCUMENTS

| | | | | |
|---|---|---|---|---|
| 2,075,714 | A | 3/1937 | Wilson | |
| 2,309,451 | A | 1/1943 | Hasenburger et al. | |
| 2,625,815 | A | 1/1953 | Black | |
| 2,772,560 | A | 12/1956 | Neptune | |
| 2,952,947 | A | 9/1960 | White | |
| 2,954,647 | A | 10/1960 | Hsiang | |
| 3,095,672 | A | 7/1963 | Di Tullio et al. | |
| 3,216,157 | A | 11/1965 | Pinter | |
| 3,298,272 | A | 1/1967 | Henderson | |
| 3,431,012 | A | 3/1969 | Eriksson et al. | |
| 3,590,538 | A * | 7/1971 | Holt | E04B 1/4121 52/127.3 |
| 3,640,328 | A | 2/1972 | Tummarello | |
| 3,705,469 | A | 12/1972 | Eriksson | |
| 3,715,851 | A | 2/1973 | Bennett | |
| 4,000,591 | A | 1/1977 | Courtois | |
| 4,204,711 | A | 5/1980 | Lancelot, III et al. | |
| 4,290,638 | A | 9/1981 | Manning | |
| 4,325,575 | A | 4/1982 | Holt et al. | |
| 4,437,276 | A | 3/1984 | Goldberg | |
| 4,512,121 | A | 4/1985 | Carydias et al. | |
| 4,627,198 | A | 12/1986 | Francies, III | |
| 4,650,276 | A | 3/1987 | Lanzisera et al. | |
| 5,257,490 | A | 11/1993 | Endo et al. | |
| 5,542,225 | A | 8/1996 | Endo et al. | |
| 5,588,263 | A | 12/1996 | Kelly et al. | |
| 5,623,804 | A | 4/1997 | Kelly et al. | |
| 5,649,782 | A | 7/1997 | Frohlich et al. | |
| 5,653,078 | A | 8/1997 | Kies et al. | |
| D436,674 | S | 1/2001 | Lancelot, III et al. | |
| D437,063 | S | 1/2001 | Lancelot, III et al. | |
| D438,649 | S | 3/2001 | Lancelot, III et al. | |
| D438,991 | S | 3/2001 | Lancelot, III et al. | |
| 6,350,093 | B1 | 2/2002 | Petersen et al. | |
| 6,460,824 | B1 | 10/2002 | Lancelot, III et al. | |
| 6,558,071 | B1 | 5/2003 | Sproules | |
| 6,647,674 | B1 | 11/2003 | Lancelot, III et al. | |
| 6,688,808 | B2 | 2/2004 | Lee | |
| 6,729,079 | B2 | 5/2004 | Francies, III et al. | |
| 6,755,385 | B2 | 6/2004 | Lancelot, III et al. | |
| 6,761,007 | B2 | 7/2004 | Lancelot, III et al. | |
| 6,769,663 | B2 | 8/2004 | Kelly et al. | |
| 6,892,722 | B1 | 5/2005 | Francies, III et al. | |
| 7,111,432 | B2 | 9/2006 | Hansort | |
| 7,222,460 | B2 | 5/2007 | Francies, III et al. | |
| 7,461,492 | B1 | 12/2008 | Francies, III et al. | |
| 7,788,860 | B2 | 9/2010 | Bartman et al. | |
| 8,667,746 | B1 | 3/2014 | Francies, III | |
| 8,677,697 | B2 | 3/2014 | Eklund et al. | |
| 8,695,287 | B1 | 4/2014 | Francies, III | |
| 8,800,220 | B1 | 8/2014 | Francies, III | |
| 8,844,239 | B2 | 9/2014 | Garot | |
| 8,875,471 | B2 | 11/2014 | Siqueiros | |
| 8,898,964 | B1 | 12/2014 | Francies, III | |
| 9,003,720 | B2 | 4/2015 | Siqueiros | |
| 9,062,452 | B2 * | 6/2015 | Espinosa | E04B 1/4171 |
| 9,151,065 | B1 | 10/2015 | Francies, III | |
| 9,222,251 | B2 * | 12/2015 | Espinosa | E04B 1/4121 |
| 9,347,232 | B1 | 5/2016 | Francies, III | |
| RE46,831 | E | 5/2018 | Francies | |
| 10,100,515 | B2 | 10/2018 | Recker | |
| 10,309,103 | B2 | 6/2019 | Recker | |
| 2003/0208969 | A1 | 11/2003 | Lancelot et al. | |
| 2006/0016140 | A1 | 1/2006 | Smith | |
| 2011/0192111 | A1 | 8/2011 | White et al. | |
| 2013/0067849 | A1 | 3/2013 | Espinosa | |
| 2014/0026515 | A1 | 1/2014 | Espinosa | |
| 2014/0053475 | A1 | 2/2014 | Siqueiros | |
| 2014/0150356 | A1 | 6/2014 | Reed | |
| 2015/0096242 | A1 | 4/2015 | Lin | |
| 2016/0138280 | A1 | 5/2016 | Lutes | |
| 2017/0226702 | A1 | 8/2017 | Connell et al. | |
| 2018/0187412 | A1 * | 7/2018 | Espinosa | E04B 1/4121 |

FOREIGN PATENT DOCUMENTS

| | | |
|---|---|---|
| JP | 2011-117128 | 6/2011 |
| KR | 2011-0043026 | 4/2011 |

OTHER PUBLICATIONS

"Inserts," Meadow Burke, Apr. 1991, Product Catalog, p. 127.
"Tilt-Up Bracing Hardware," Meadow Burke, Jan. 2004, Product Catalog, pp. 90-91.
"Vertical Adjustment Tube Non-Structural Item," MeadowBurke, schematic diagram A-4205, Mar. 11, 2008, 1 page.
"(Special) Vertical Adjustment Assembly," MeadowBurke, schematic diagram A-1344, Nov. 18, 2003, 1 page.
"Vertical Adjustment Plate Non-Structural Item," MeadowBurke, schematic diagram A-5731, Jul. 15, 2011, 1 page.
"Leveling Insert (Gracie)," MeadowBurke, schematic diagram A-6225, Jul. 29, 2013, 1 page.
Official Action for U.S. Appl. No. 15/656,486, dated Feb. 22, 2018, 7 pages.
Notice of Allowance for U.S. Appl. No. 15/656,486, dated Jun. 28, 2018 7 pages.
Corrected Notice of Allowability for U.S. Appl. No. 15/656,486, dated Jul. 23, 2018 3 pages.
Official Action for U.S. Appl. No. 15/994,087, dated Sep. 7, 2018 11 pages.
Notice of Allowance for U.S. Appl. No. 15/994,087, dated Jan. 23, 2019 9 pages.

* cited by examiner

LIFTING AND LEVELING INSERT FOR A PRECAST CONCRETE SLAB

CROSS-REFERENCE TO RELATED APPLICATIONS

This U.S. Non-Provisional Patent Application is a Continuation of and claims priority to U.S. patent application Ser. No. 15/994,087, filed May 31, 2018, which is a Continuation-in-Part of and claims priority to U.S. patent application Ser. No. 15/656,486, filed Jul. 21, 2017, which claims priority to U.S. Provisional Patent Application No. 62/365,271 filed Jul. 21, 2016, the entire disclosures of which are hereby incorporated by reference in their entirety.

FIELD OF THE INVENTION

This invention generally relates to precast concrete slabs and specifically to systems and devices embedded in precast concrete slabs that adjust the elevation of the concrete slab relative to a ground surface.

BACKGROUND OF THE INVENTION

Precast concrete slabs provide convenience to contractors and builders since precast concrete slabs can be manufactured offsite. Instead of pouring concrete onsite and waiting for the concrete to cure, builders can buy or manufacture as many precast concrete slabs as needed, then install them onsite, which reduces the time required to put a concrete slab in place. Precast concrete slabs can be used in a variety of projects including buildings, bridges, and even roads. A section of road may be cut out around a pothole, and then a precast concrete slab is lowered in place to quickly repair the pothole or other defect in the road.

One issue with using precast concrete slabs to repair roads is that the precast concrete slab must be level with the other portions of the road. A misaligned precast concrete slab can wear a tire or even cause heavy damage to a vehicle. One attempt to solve this issue may be found in U.S. Pat. Nos. 8,875,471 and 9,003,720 to Baltazar, which are incorporated herein in their entireties by reference. These patents describe a system whereby a sleeve is embedded in a precast concrete slab, and the sleeve extends through the concrete slab. A bolt is threaded into the sleeve, and a top end of the bolt has an eyelet that allows builders to transport and lower the precast concrete slab in place. Then, the bolt may be driven in further into the sleeve so that a bottom end of the bolt extends through the sleeve and out of the bottom side of the slab. The bottom end of the bolt contacts a plate, which causes the entire concrete slab to rise. Once the precast concrete slab is in the proper alignment, grout is pumped underneath the slab to set the slab in place.

One shortcoming of the device in the Baltazar patents is that a single bolt is used to both transport the precast concrete slab and contact a plate underneath the concrete slab. Accordingly, the bolt must be long enough to extend through the entire concrete slab, and therefore, the bolt has a potential risk of buckling or being subjected to a large moment force as the eyelet or top of the bolt is lifted and moved by cables. Even having just one bolt buckle can hinder the ability of the precast concrete slab to align with a road surface. This results in a loss of time, which defeats the advantage of having a precast concrete slab. Therefore, there is a need for a device, a system, and/or a method for leveling a precast concrete slab that does not have a single continuous bolt that extends through the entire precast concrete slab.

SUMMARY OF THE INVENTION

It is thus an aspect of embodiments of the present invention to provide an insert embedded in a precast concrete slab that has a two-bolt design for lifting and then leveling the precast concrete slab. The sleeve portion of the insert has two distinct threaded portions along the longitudinal length of the sleeve to accommodate the two-bolt design. A first lifting bolt is inserted into a first threaded portion proximate to the top surface (road side) of the precast concrete slab for transporting the slab. Then a second leveling bolt is used in a second threaded portion that is proximate to the bottom surface of the slab, and engagement of the second bolt causes a plate to raise the precast concrete slab relative to the road surface or any other ground surface. The two-bolt design can use shorter, and thus, stiffer bolts to reduce the likelihood of buckling and reduce the moment forces on the bolts.

It is an aspect of embodiments of the present invention to provide an insert for lifting and leveling a precast concrete slab that has a sleeve with two threaded portions on an inner surface of the sleeve that are different sizes. In some embodiments, the threaded portion positioned proximate to the upper surface of the concrete slab has a larger diameter than the threaded portion positioned proximate to the lower surface of the concrete slab. Accordingly, the lifting bolt positioned in the upper threaded portion has a larger diameter than the leveling bolt positioned in the lower threaded portion. This configuration is advantageous since the lifting bolt can be used to position the concrete slab, and then the lifting bolt is removed to provide access to the lower threaded portion. The leveling bolt can pass through the upper threaded portion, through the length of the sleeve and then engage the lower threaded portion. It will be appreciated that in some embodiments of the invention, the upper and lower threaded portions may have smaller and larger diameters, respectively, or even equal diameters.

It is a further aspect of embodiments of the present invention to provide an insert for lifting and leveling a precast concrete slab where the point of engagement for the lifting bolt and the leveling bolt is proximate to the upper surface and the lower surface, respectively, of the precast concrete slab. This close positioning between the bolts and the relevant bearing surfaces creates a more robust system. For example, the lifting system that lifts and moves the concrete slab through the lifting bolt imposes a moment force on the lifting bolt when a cable that connects to the lifting bolt is out of plumb or forms an angle with the concrete slab, specifically, the longitudinal axis of the sleeve. Since the lifting bolt engages the threaded portion near the upper surface of the slab, the moment force is reduced. Similarly, the leveling bolt engages a plate at the lower surface of the slab, and drives the plate into a ground surface. Because the leveling bolt engages a threaded portion that is proximate to the lower surface of the slab, there is a reduced likelihood of the leveling bolt buckling under a large force.

It is an aspect of embodiments of the present invention to provide an insert for lifting and leveling a precast concrete slab where a plate is affixed to the insert via a plug. The plug can provide a severable interconnection to the concrete slab in a number of ways, including being threaded into the lower threaded portion of the sleeve and a friction fit in the sleeve.

The plug in some embodiments may be a plastic such as polymer. The plug simplifies installation of the insert in a concrete slab since all of the parts of the insert are secured together before setting the insert in the slab. During operation, the leveling bolt travels out of the bottom surface of the insert and clears the plug out of the lower threaded insert. The plate detaches from the sleeve of the insert, and then the leveling bolt can drive the plate into the ground surface to raise part of the concrete slab to align the concrete slab as needed. In further embodiments, the plate may be operably interconnected to the sleeve or other portion of the insert by, for example, an adhesive, wires, tubular spacers, etc.

Once the slab is aligned, grout can be pumped underneath the precast concrete slab to set the slab in place. In some embodiments, the precast concrete slab has separate apertures that extend through the slab to provide access underneath the slab. A tube or conduit can direct grout or any other similar material through one or more separate apertures to the space underneath the precast concrete slab. In some embodiments, the bolts and/or the sleeve of a given insert may comprise apertures or channels that allow grout to be pumped through the insert and then allow grout to fill the insert to serve as the last space that needs to be filled before the pumping ceases. In other words, once grout fills up the insert and any of the apertures, then the filling process is complete.

On particular embodiment of the present invention is an apparatus for lifting and leveling a precast concrete slab, comprising a sleeve configured to be embedded in the precast concrete slab, the sleeve having a predetermined length, an upper thread extending along an inner surface of the sleeve by a distance that is shorter than the predetermined length, and a lower thread extending along the inner surface of the sleeve by a distance that is shorter than the predetermined length; a lifting bolt positioned in the upper thread of the sleeve; a leveling bolt positioned in the lower thread of the sleeve, the leveling bolt having a length that is shorter than the predetermined length of the sleeve; and a plate positioned on a lower end of the sleeve, wherein the plate is configured to extend away from the lower end of the sleeve as the leveling bolt is selectively rotated in the lower thread, which selectively elevates or lowers the precast concrete slab above a ground surface.

In some embodiments, the upper thread has a larger diameter than the lower thread. In various embodiments, the apparatus further comprises an unthreaded portion of the sleeve extending along the inner surface of the sleeve between the upper thread and the lower thread, the unthreaded portion having a smaller diameter than the upper thread. In some embodiments, a plurality of legs extends from an outer surface of the sleeve.

In various embodiments, legs of the plurality of legs are equally spaced radially about a longitudinal axis of the sleeve. In some embodiments, the apparatus further comprises a plug that provides a severable interconnection between the plate and the lower surface of the sleeve. In various embodiments, the sleeve and the plate are comprised of a metallic material.

In some embodiments, the lifting bolt is configured to be selectively removable from the upper thread of the sleeve. In various embodiments, the sleeve is formed from a coiled tube wrapped about a longitudinal axis. In some embodiments, the lifting bolt comprises a connection feature that is configured for selective interconnection with a device to position the sleeve and the precast concrete slab.

Another particular embodiment of the present invention is a method of embedding a lifting and leveling insert in a precast concrete slab, comprising (i) providing an insert having (a) a sleeve with an upper threaded portion and a lower threaded portion on an inner surface of the sleeve, wherein the upper threaded portion has a larger diameter than the lower threaded portion; (b) a plate operably positioned on a lower end of the sleeve; (c) a plurality of legs extending from an outer surface of the sleeve; and (ii) pouring concrete around the sleeve of the insert in a concrete form to create a precast concrete slab, wherein the plate is operably positioned at a lower surface of the concrete slab to selectively detach from the lower surface of the concrete slab.

In some embodiments, the sleeve has an unthreaded portion extending along the inner surface of the sleeve between the upper threaded portion and the lower threaded portion, the unthreaded portion having a smaller diameter than the upper threaded portion. In various embodiments, the sleeve is formed from a coiled tube wrapped about a longitudinal axis. In some embodiments, the method further comprises (iii) engaging a lifting bolt in the upper threaded portion of the sleeve to lift and position the insert and the precast concrete slab over a ground surface. In various embodiments, the method further comprises (iv) engaging a leveling bolt in the lower threaded portion of the sleeve to detach the plate from the lower surface of the concrete slab and to elevate the concrete slab over a ground surface.

Yet another particular embodiment of the present invention is a method of transporting and setting a precast concrete slab with an insert, comprising (v) providing an insert in a precast concrete slab, wherein the insert has a sleeve with an upper threaded portion and a lower threaded portion on an inner surface of the sleeve, wherein the upper threaded portion has a larger diameter than the lower threaded portion, and wherein the insert comprises a plate that is selectively detachable from the sleeve and a lower surface of the precast concrete slab; (vi) engaging a lifting bolt in the upper threaded portion of the sleeve; (vii) lifting the precast concrete slab with the lifting bolt into a position on a ground surface; (viii) removing the lifting bolt from the upper threaded portion; and (ix) engaging a leveling bolt in the lower threaded portion of the sleeve such that the plate of the insert detaches from the sleeve and the lower surface of the precast concrete slab and raises the precast concrete slab above the ground surface to a predetermined elevation.

In some embodiments, the method further comprises (x) positioning grout underneath the precast concrete slab to set the precast concrete slab at the predetermined elevation over the ground surface. In various embodiments, the sleeve is formed from a coiled tube wrapped about a longitudinal axis. In some embodiments, the sleeve has an unthreaded portion extending along the inner surface of the sleeve between the upper threaded portion and the lower threaded portion, the unthreaded portion having a smaller diameter than the upper threaded portion. In various embodiments, a plurality of legs extend from an outer surface of the sleeve into the precast concrete slab.

One particular embodiment of the present invention is an insert for lifting and leveling a precast concrete slab, comprising a sleeve configured to be embedded in a precast concrete slab, the sleeve having a predetermined total length; an upper thread extending along an inner surface of the sleeve by a distance that is shorter than the predetermined total length, wherein the upper thread is configured to receive a lifting bolt for hoisting and positioning the precast concrete slab; a lower thread extending along the inner surface of the sleeve by a distance that is shorter than the predetermined total length, wherein the lower thread is configured to receive a leveling bolt that is shorter than the predetermined total length of the sleeve; and a plate selectively interconnected to a lower end of the sleeve, wherein the plate is configured to extend away from the lower end of the sleeve as the leveling bolt rotates in the lower thread.

In some embodiments, the sleeve is a continuous wire. In various embodiments, the continuous wire has a substantially constant cross-sectional dimension along a total length of the continuous wire. In some embodiments, the sleeve has an outer diameter in an area of the upper thread that is larger than an outer diameter in an area of the lower thread. In various embodiments, the insert further comprises at least one leg interconnected to an outer surface of the sleeve in the area of the upper thread. In some embodiments, an inner diameter of the upper thread is greater than an inner diameter of the lower thread. In various embodiments, the insert further comprises a lower plug interconnected to the plate, which is configured to provide an interference fit with the lower end of the sleeve to remotely interconnect the plate to the lower end of the sleeve.

Another particular embodiment of the present invention is a method for manufacturing a first insert for lifting and leveling a precast concrete slab, comprising (i) turning a continuous wire about a longitudinal axis to produce a first portion of a first sleeve for a first insert, the first portion having an inner diameter configured to receive a first bolt; (ii) turning the continuous wire about the longitudinal axis to produce a transition portion from the first portion to a second portion of the first sleeve; (iii) turning the continuous wire about the longitudinal axis to produce the second portion, the second portion having an inner diameter configured to receive a second bolt, wherein the inner diameter of the first portion is distinct from the inner diameter of the second portion; and (iv) cutting the continuous wire after producing the second portion.

In various embodiments, the method further comprises (v) selectively interconnecting a plate to the first portion. In some embodiments, the method further comprises (vi) rotating the first bolt to contact the plate and disengage the plate from the first portion. In various embodiments, the continuous wire has a substantially constant cross-sectional diameter along a total length of the continuous wire.

In some embodiments, the method further comprises (vii) manufacturing a second insert for lifting and leveling a precast concrete slab by: (viii) turning the continuous wire about the longitudinal axis to produce a second portion of a second sleeve of the second insert; (ix) turning the continuous wire about the longitudinal axis to produce a transition portion from the second portion of the second sleeve to a first portion of the second sleeve; and (x) turning the continuous wire about the longitudinal axis to produce the first portion of the second sleeve, wherein an inner diameter of the second portion of the second sleeve is substantially the same as the inner diameter of the second portion of the first sleeve. In various embodiments, the first portion is a lower portion and the second portion is an upper portion, and the inner diameter of the upper portion is larger than the inner diameter of the lower portion, wherein the first bolt is a leveling bolt and the second bolt is a lifting bolt, wherein rotation of the leveling bolt through the lower portion engages the plate to push the first insert in an upward position. In some embodiments, manufacturing of the first portion of the first sleeve occurs prior to production of the second portion of the first sleeve, which occurs prior to production of the second portion of the second sleeve, which occurs prior to production of the first portion of the second sleeve.

Yet another particular embodiment of the present invention is a precast concrete panel with an apparatus for lifting and leveling the precast concrete panel, comprising a precast concrete panel having an upper surface, a lower surface, and perimeter edges extending therebetween; a sleeve configured to be embedded in the precast concrete panel, the sleeve having a predetermined total length, and the sleeve made from a continuous wire; an upper portion of the sleeve having an inner diameter configured to receive a lifting bolt to position the precast concrete panel; and a lower portion of the sleeve having an inner diameter configured to receive a leveling bolt, the inner diameter of the lower portion is smaller than the inner diameter of the upper portion.

In various embodiments, the panel further comprises a plate positioned proximate to the lower portion of the sleeve, wherein rotation of the leveling bolt through the lower portion of the sleeve engages the plate positioned below the lower portion. In some embodiments, the panel further comprises a lower plug interconnected to the plate, wherein the lower plug is configured to provide an interference fit with the lower portion to provide the selective interconnection of the plate to the lower portion. In various embodiments, an opening of the upper portion is configured to be positioned proximate to the upper surface of the precast concrete panel, and an opening of the lower portion is configured to be positioned proximate to the lower surface of the precast concrete panel. In some embodiments, the upper portion has a length less than the predetermined total length of the sleeve, and the lower portion has a length less than the predetermined total length of the sleeve. In various embodiments, the panel further comprises at least one leg interconnected to an outer surface of the upper portion of the sleeve, wherein each leg is made from a continuous wire, wherein the continuous wire of each leg has substantially the same cross-sectional dimension as the continuous wire of the sleeve.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the invention. Moreover, references made herein to "the invention" or aspects thereof should be understood to mean certain embodiments of the invention and should not necessarily be construed as limiting all embodiments to a particular description. The invention is set forth in various levels of detail in the Summary of the Invention as well as in the attached drawings and Detailed Description and no limitation as to the scope of the invention is intended by either the inclusion or non-inclusion of elements, components, etc. in this Summary of the Invention. Additional aspects of the invention will become more readily apparent from the Detailed Description particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

Figure 1:
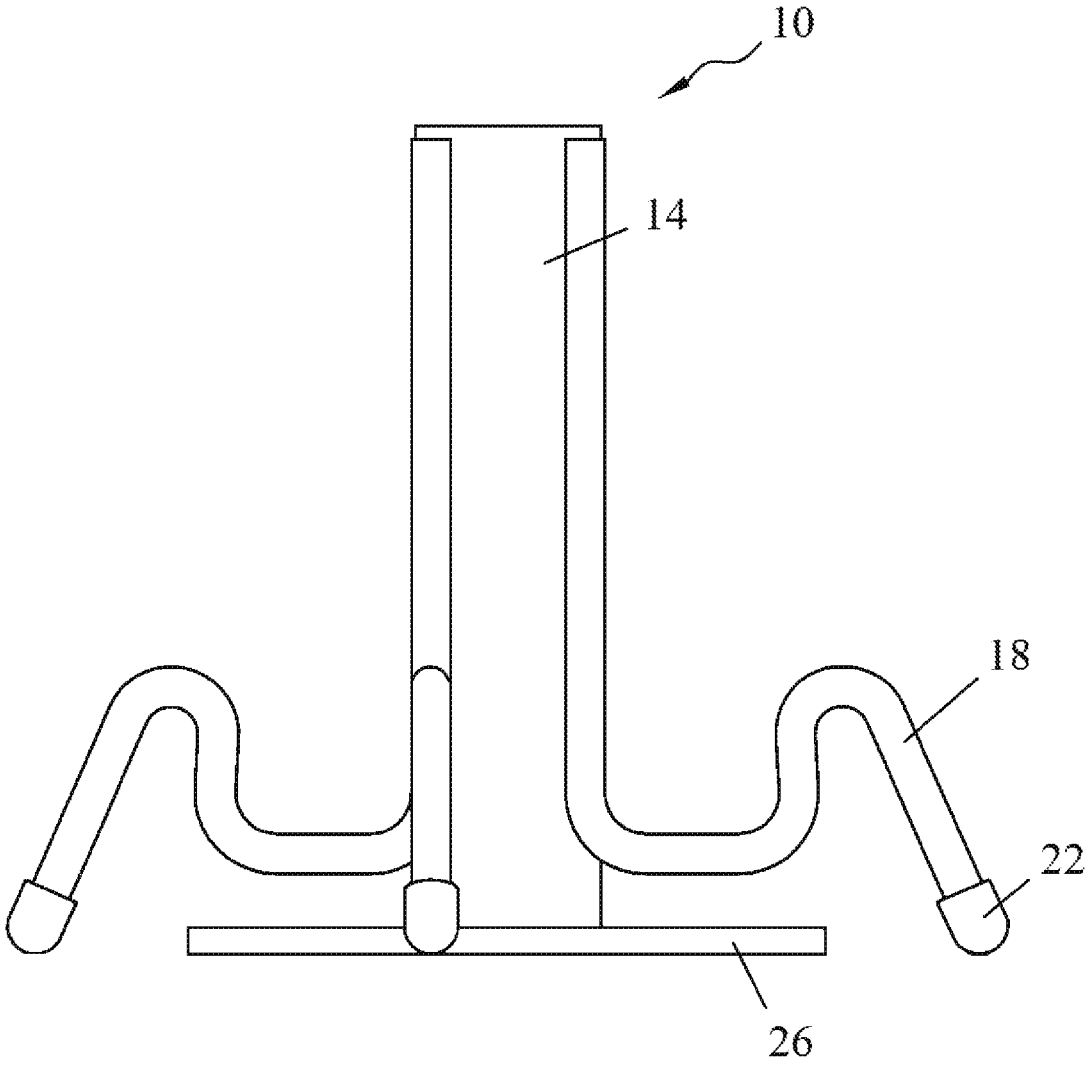
FIG. 1 is a front elevation view of an insert in accordance with an embodiment of the present invention.

To assist in the understanding of the embodiments of the invention the following list of components and associated numbering found in the drawings is provided herein:

| Component No. | Component |
|---|---|
| 10 | Insert |
| 14 | Sleeve |
| 18 | Leg |
| 22 | Leg Tip |
| 26 | Plate |
| 30 | First Threaded Portion |
| 34 | Lifting Bolt |
| 38 | Second Threaded Portion |
| 42 | Leveling Bolt |
| 46 | Precast Concrete Slab |
| 50 | Ground Surface |
| 54 | Insert Height |
| 58 | Leg Height |
| 62 | Plate Spacing |
| 66 | Leg Spacing |
| 70 | Leg Angle |
| 74 | Plate Width |
| 76 | Wire |
| 78 | Upper Portion |
| 80 | First Outer Diameter |
| 82 | Lower Portion |
| 84 | Second Outer Diameter |
| 86 | Upper Plug |
| 88 | Lower Plug |

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, and may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the invention are described herein and as depicted in the drawings. It is expressly understood that although the figures illustrate inserts, sleeves, bolts, etc., the invention is not limited to these embodiments.

Now referring to FIG. 1, a front elevation view of an insert 10 is provided. The insert 10 comprises a tubular sleeve 14 and legs 18 that extend from an outer surface of the sleeve 14. When the insert 10 is embedded in a precast concrete slab, the sleeve 14 is oriented to extend through the thickness dimension, or smallest dimension, of the slab. Thus, the legs 18 extend laterally into the slab to provide support and stability. The legs 26 may have optional plastic tips 28 disposed on the distal ends of the legs 26 to improve the safety for those who handle the insert 10.

In addition, a plate 26 is positioned at one end of the sleeve 14. In practice, the plate 26 is substantially parallel with a lower surface of the precast concrete slab, and the plate 26 is oriented to contact a ground surface. The plate 26 is configured to selectively detach from the sleeve 14 and the precast concrete slab to elevate or lower the sleeve 14 and the precast concrete slab above the ground surface. With a precast concrete slab that has multiple insert systems 10, the particular elevation and orientation of the precast concrete slab can be controlled so that, for example, the precast concrete slab is flush with a road surface to repair a road.

It will be appreciated that the sleeve 14 may be machined from a tubular structure or cast into a tubular structure, in some embodiments. It will be further appreciated that the sleeve 14 can be formed from coiled tubing that is turned about a longitudinal axis to form the sleeve 14. Complementary bolts configured to thread within coil tubing are also contemplated for embodiments of the present invention.

Figure 2:
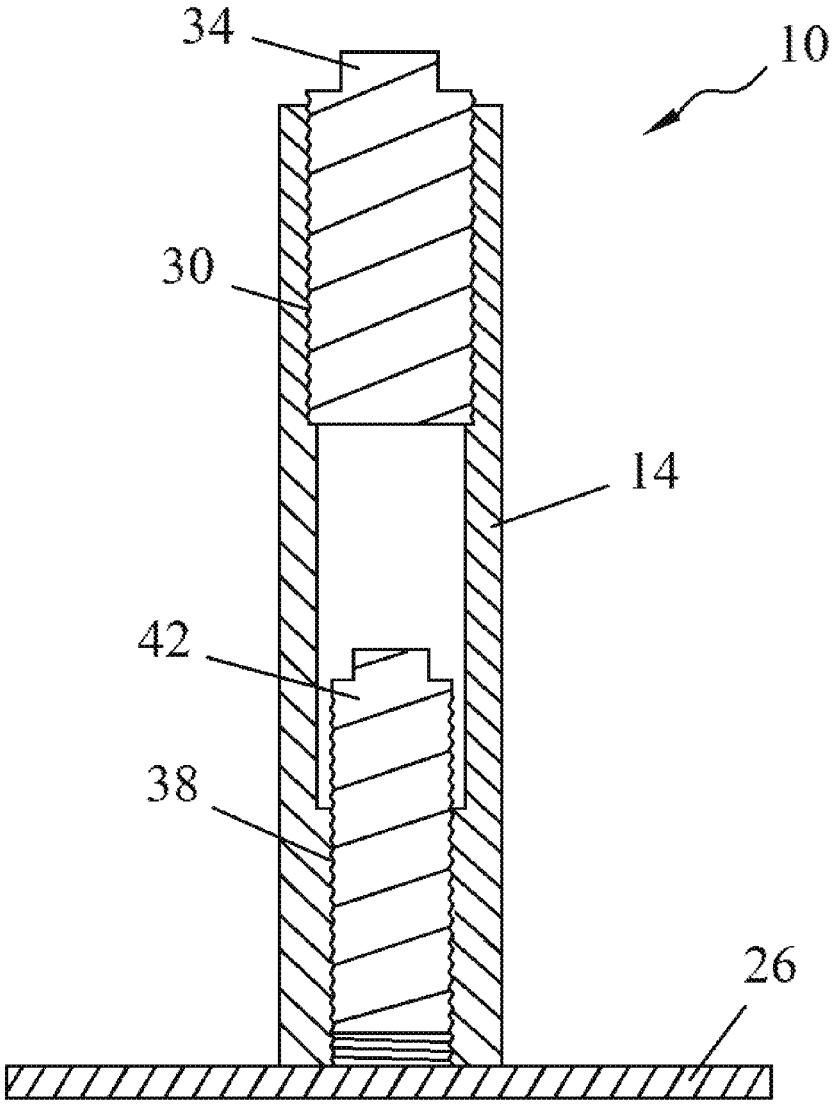
FIG. 2 is a cross-sectional view of the insert of FIG. 1 in accordance with an embodiment of the present invention.

Now referring to FIG. 2, a cross-sectional view of the insert 10 is provided. The sleeve 14 comprises a first threaded portion 30 and a second threaded portion 38. The first threaded portion 30 is positioned at the end of the sleeve 14 that is proximate to the top surface of the precast concrete slab. The first threaded portion 30 may extend only partially along the longitudinal length of the sleeve 14. In some embodiments, the first threaded portion 30 is disposed only on an upper half of the sleeve 14. In various embodiments, the first threaded portion 30 does not extend to the top edge of the sleeve 14.

The sleeve 14 also comprises a second threaded portion 38, which like the first threaded portion 30, may extend only partially along the longitudinal length of the sleeve 14. In some embodiments, the second threaded portion 38 is disposed only on a lower half of the sleeve 14. In various embodiments, the second threaded portion 38 does not extend to the bottom edge of the sleeve 14. Further still, the first and second threaded portions 30, 38 may meet at a midpoint or other point of the sleeve 14 such that the portions 30, 38 are adjacent to each other. Various embodiments of the invention may include an unthreaded portion that is positioned between the threaded portions 30, 38, and in some embodiments, the unthreaded portion has a smaller diameter than the first threaded portion 30 to prevent a lifting bolt from extending further down the sleeve 14.

As noted elsewhere herein, the first threaded portion 30 may have a larger diameter than the second threaded portion 38. In various embodiments, the first threaded portion 30 may have a diameter between approximately 2" and ½". In some embodiments, the first threaded portion 30 may have a diameter of approximately 1¼". In various embodiments, the second threaded portion 38 may have a diameter between approximately 1¾" and ¼". In some embodiments, the second threaded portion 38 may have a diameter of approximately 1".

FIG. 2 also shows the lifting bolt 34 and the leveling bolt 42. The lifting bolt 34 is configured to engage the first threaded portion 30, and the leveling bolt 42 is configured to engage the second threaded portion 38. Just as the first threaded portion 30 has a larger diameter than the second threaded portion 38, the lifting bolt 34 has a larger diameter than the leveling bolt 42. This allows the leveling bolt 42 to be first inserted through the top end of the sleeve 14, through the sleeve 14, and into the second threaded portion 38. Then, the lifting bolt 34 may be inserted into the first threaded portion 30. Alternatively, during operation of the insert 10, the lifting bolt 34 may be used and then discarded before the leveling bolt 42 is inserted through the sleeve 14 into the second threaded portion 38. The lifting bolt 34 may have a connection feature such as an aperture, a ring, an eyelet, etc. that allows a separate device such as a crane to selectively interconnect to the lifting bolt 34.

It will be appreciated that in preferred embodiments, the lifting bolt 34 and the leveling bolt 42 are shorter than the predetermined distance between both ends of the sleeve 14 or the thickness of the precast concrete slab. However, it will also be appreciated that in other embodiment, one or both of the lifting bolt 34 and the leveling bolt 42 may have a length that is equal to or greater than the predetermined distance.

Figure 3:
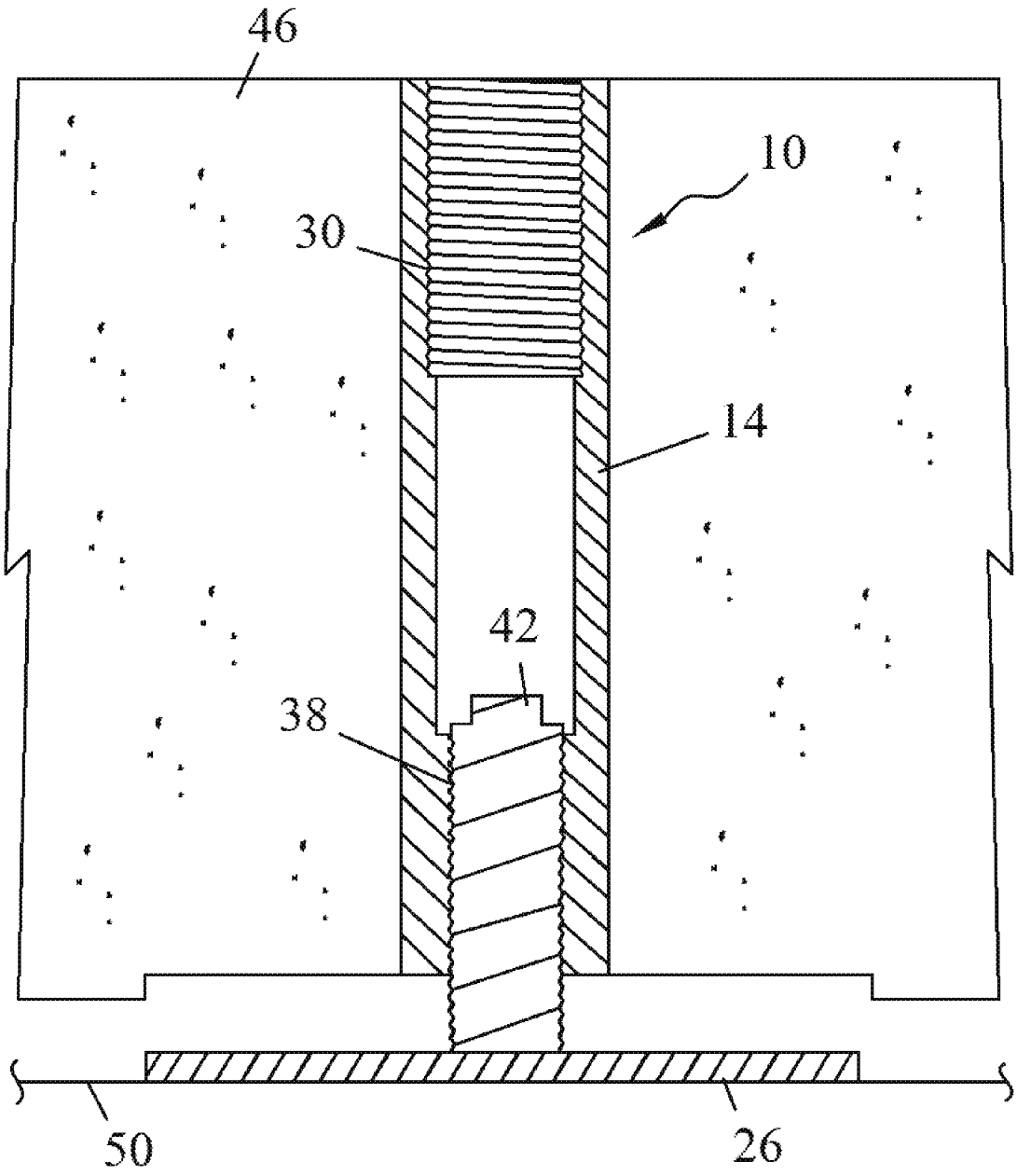
FIG. 3 is a cross-sectional view of the insert of FIG. 1 in a precast concrete slab in accordance with an embodiment of the present invention.

Now referring to FIG. 3, a cross-sectional view of the insert 10 is provided where the insert 10 is elevated above a ground surface 50. As shown, the insert 10 has been embedded in a precast concrete slab 46, and the sleeve 14 is oriented such that a longitudinal dimension of the sleeve 14 extends through a thickness of the precast concrete slab. The lifting bolt has been utilized to position the precast concrete slab 46 over a ground surface 50, and has been subsequently removed. Next, the leveling bolt 42 is driven into the plate 26 such that the plate 26 detaches from the lower end of the sleeve 14 and the bottom surface of the slab 42. The leveling bolt 42 elevates the sleeve 14 and the precast concrete slab 46 above the plate 26 and the ground surface 50 by a predetermined height. Lastly, grout can be pumped underneath the precast concrete slab 46 to set the precast concrete slab 46 at the predetermined height. The precast concrete slab 46 may have separate apertures that extend through the thickness of the precast concrete slab 46 to provide access underneath the precast concrete slab 46 for the grout.

The sleeve 14 of the insert 10 extends substantially between the top and bottom surfaces of the precast concrete slab 46. However, it will be appreciated that in other embodiments, the length of the sleeve 14 may be shorter or longer than the thickness of the precast concrete slab 46. For instance, a top end of the sleeve 14 may be short of the top surface of the precast concrete slab 46, a bottom end of the sleeve 14 may be short of the bottom surface of the precast concrete slab 46, or both ends may be short. Further still, in some embodiments, a tubular spacer may be positioned between an end of the sleeve 14 and a surface of the precast concrete slab 46.

Another feature of the insert 10 is a plug, which interconnects the plate 26 to the sleeve 14 of the insert 10. The plug can interconnect the plate 26 to the sleeve 14 in a variety of ways. In some embodiments, the plug is a plastic portion that engages part of the second threaded portion 38 of the sleeve 14. When the leveling bolt 42 is engaged, the plug is driven out of the sleeve and the leveling bolt 42 drives the plate 26 into the ground surface 50. In various embodiments, the plug may interconnect to the sleeve 14 through an interference fit, which again, may be forced out of the sleeve 14 during engagement of the leveling bolt 42.

Figure 4:
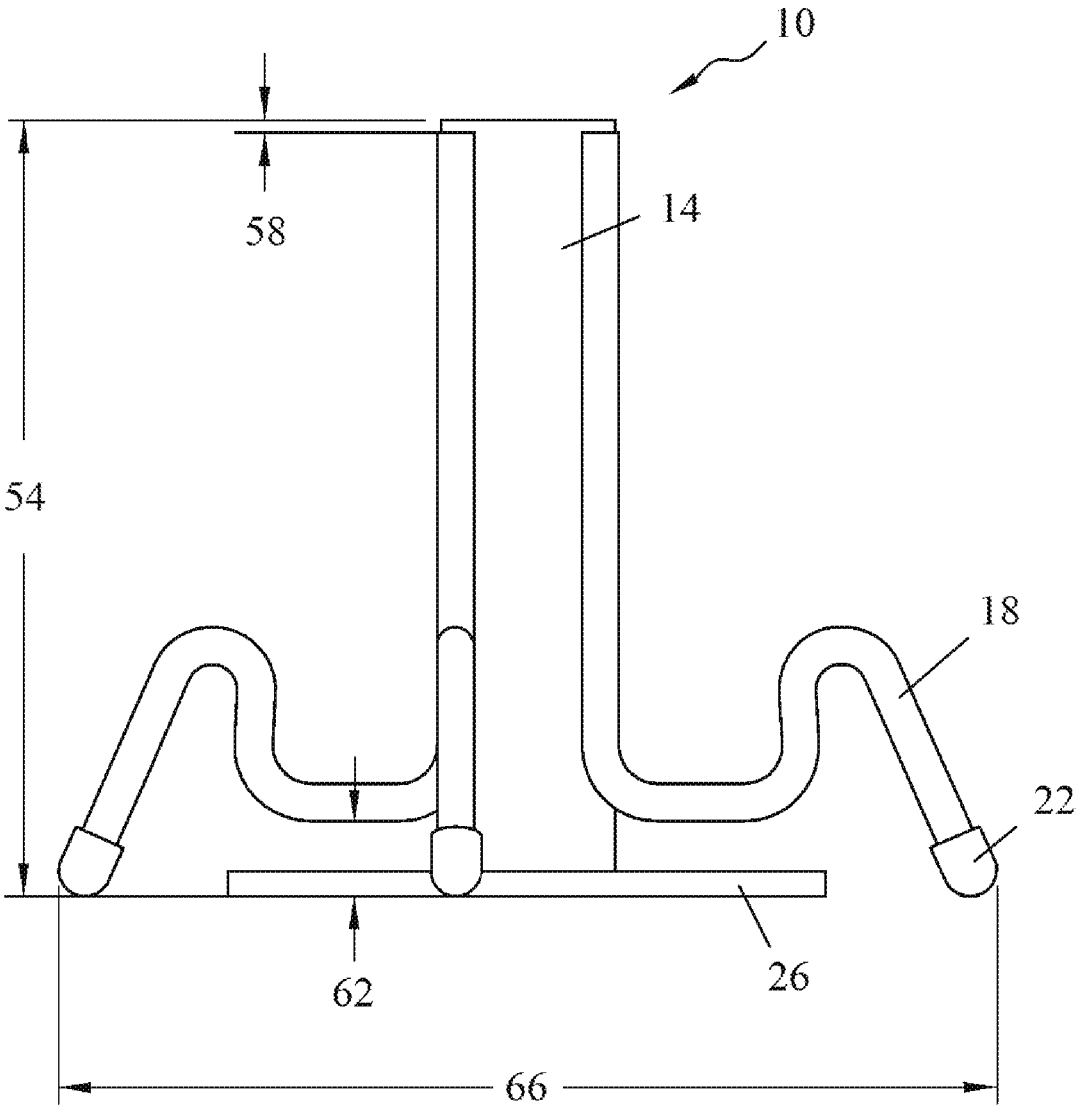
FIG. 4 is an additional front elevation view of the insert of FIG. 1 in accordance with an embodiment of the present invention.

Now referring to FIG. 4, a front elevation view of the insert 10 with dimensions is provided. The sleeve 14 also has an insert height 54 and a leg height 58. The insert height 54 may be any height to accommodate any size precast concrete slab. In some embodiments, the insert height 54 is approximately 7¾". An optional leg height may extend between the end of a leg and the top of the sleeve 14. In some embodiments, the leg height 58 is approximately ⅛".

The plate 26 is disposed at the bottom end of the sleeve 14 on the bottom surface of the precast concrete slab. There is a spacing 62 between the plate 26 and the legs 18 of the insert 10, which are discussed further below. In some embodiments, the plate spacing 62 is approximately ¾".

Like with other dimensions discussed herein, the spacing from the end of one leg 18 to the end of another leg 18 may be any size to accommodate the dimensions and needs of a particular insert 10 and precast concrete slab. In some embodiments, the leg spacing 66 is approximately 9⅜". Further, the legs 18 in some embodiments may be ⅜" diameter wire. In addition, the legs 18 in some embodiments may have a proximal end that is interconnected to the outer surface of the sleeve 14 and a distal end that extends downward toward the lower end of the sleeve 14. Specifically, in some embodiments, the distal end of the legs 18 lies in a common plane with the lower end of the sleeve 14 and the plate 26.

Figure 5:
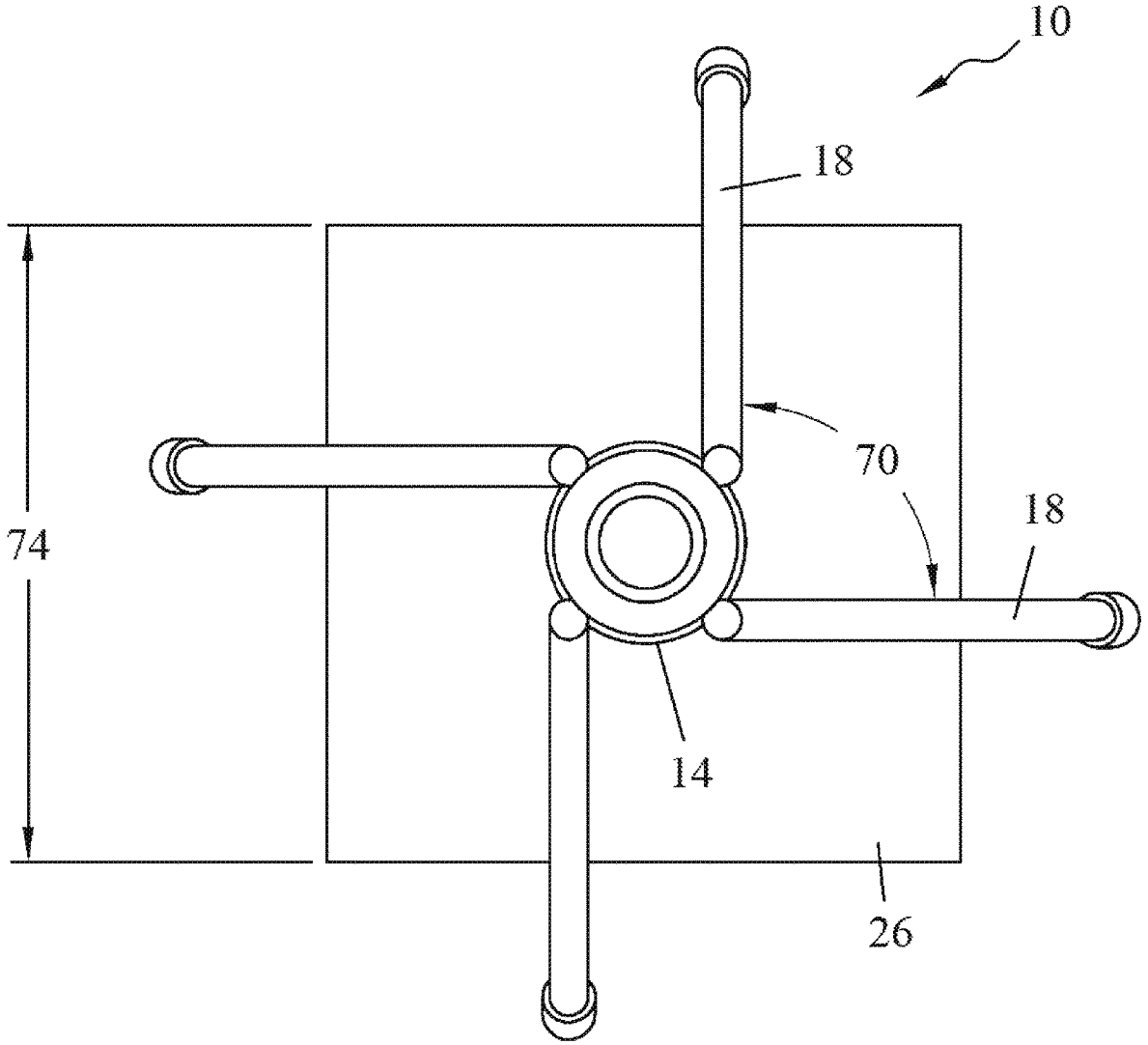
FIG. 5 is a top plan view of the insert of FIG. 1 in accordance with an embodiment of the present invention.

Now referring to FIG. 5 a top plan view of the insert 10 with dimensions is provided. The insert 10 has four legs 18 arrayed about the sleeve 14. The legs 18 are equally spaced about the sleeve 14, and the angle 70 between the legs 18 in this embodiment is approximately 90 degrees. It will be appreciated that legs 18 in other embodiments of the invention may have more or fewer than four legs 18, and the configuration of the legs 18 may also be different. For example, the legs 18 may be arrayed asymmetrically about the sleeve 14.

Lastly, the plate 26 in FIG. 5 is square has a width 74 that is a 6". However, it will be appreciated that the plate may have other shapes, dimensions, and materials to allow the leveling bolt to thread through the second threaded portion of the sleeve 14 and drive the plate into the ground surface to raise the precast concrete slab.

Figure 6:
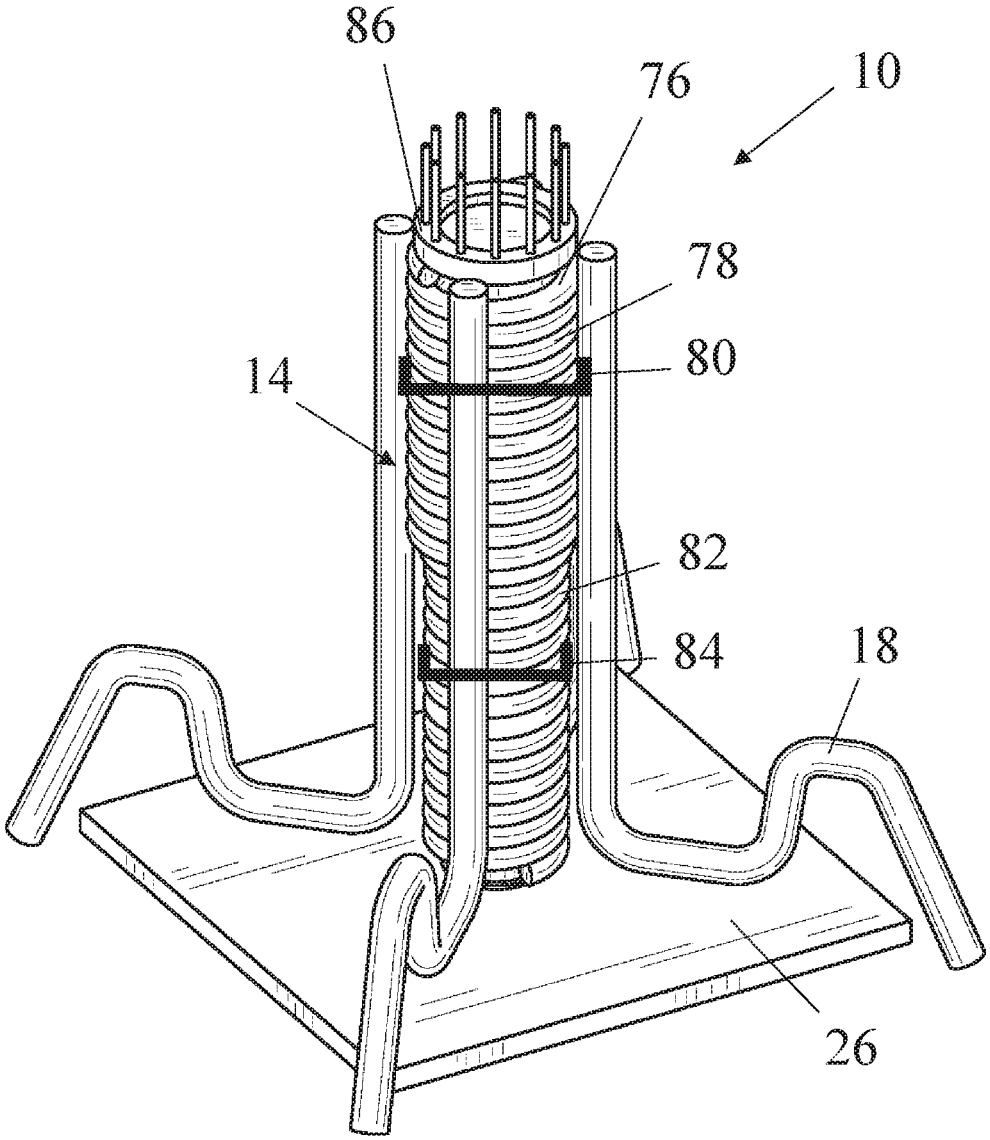
FIG. 6 is a perspective view of another insert made from coiled wire in accordance with an embodiment of the present invention.

Now referring to FIG. 6, a perspective view of another insert 10 is provided. In this embodiment, the insert 10 has a sleeve 14 made from a coiled wire, which can be less expensive and faster to produce than other types of sleeves that require milling, threading, etc. The sleeve 14 in this embodiment comprises an upper portion 78 and a lower portion 82 and a transition portion disposed therebetween. The upper portion 78 has a first outer diameter 80 that is larger than a second outer diameter 84 of the lower portion 82. Since the sleeve 14 is made from a continuous wire with a constant thickness, the upper portion 78 has an inner diameter that is larger than an inner diameter of the lower portion 82 by the same distance that the first outer diameter 80 is larger than the second outer diameter 84.

To manufacture the sleeve 14 in FIG. 6, first, the lower portion 82 is produced by turning a wire about an axis and at the outer diameter 84. The wire is coiled for a predetermined length along the axis, and then the diameter of the wire transitions from the outer diameter 84 of the lower portion 82 to a larger outer diameter 80 of the upper portion 78. The wire is coiled for another predetermined length along the axis, and the wire is then cut, which leaves the sleeve 14 with two different-sized outer diameters 80, 84 made from a continuous wire. The next wire sleeve 14 can be made in reverse to minimize waste and increase production speed. The upper portion 78 is created first, and then the wire transitions from the outer diameter 80 of the upper portion 78 to the outer diameter 84 of the lower portion 82. Multiple sleeves 14 made from continuous wire can be manufactured in this alternating process.

After forming the sleeve 14, other components can be added to the sleeve 14 to make the insert 10. Legs 18 can be bent and manufactured into a predetermined shape and then connected to the sleeve 14, for example, by welding. The legs 18 further secure the insert 10 to the precast concrete slab. Specifically, in this embodiment, legs 18 are connected to the upper portion 78 and evenly arranged about a central axis of the sleeve 14. It will be appreciated that any number of legs 18, more or less than four, can be connected to the sleeve 14 in any configuration and/or orientation.

Figure 7:
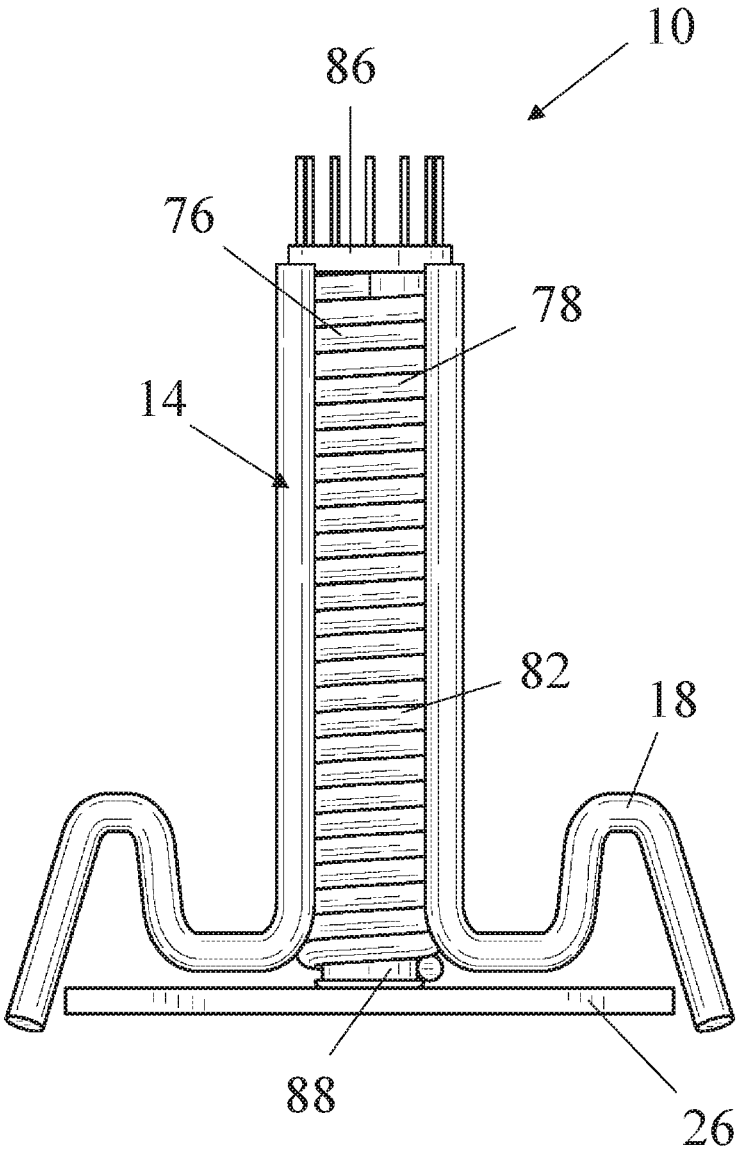
FIG. 7 is a front elevation view of the insert in FIG. 6 in accordance with an embodiment of the present invention.

Plugs 86, 88 can help prevent cement or concrete from entering the interior of the sleeve 14 as the insert 10 is encased in a precast concrete slab. The top plug 86 shown in FIGS. 6 and 7 is insertable into the sleeve 14 to close the upper opening of the sleeve 14. The top plug 86 can be threadably secured or even secured with an interference or friction fit to the sleeve 14. After the precast concrete slab has cured, the top plug 86 can be removed to provide access to the interior of the insert 10 for lifting and leveling bolts. Similarly, the lower plug 88 shown in FIG. 7 can connect to the lower opening of the sleeve 14 using, for example, a threadable connection or an interference fit. In other embodiments, the plate 26 can directly provide a threadable connection or an interference fit. The lower plug 88 can be secured to the plate 26 by inserting a screw or bolt from a bottom surface of the plate 26, through the plate 26, and into the lower plug 88. During operation, a leveling bolt can drive the lower plug 88 out of the sleeve 14. To aid with this functionality, the top surface of the lower plug 88 can have a concave shape to center and stabilize the leveling bolt as the leveling blot drives the lower plug 88 out of the sleeve 14.

Specialized lifting and leveling bolts can interact with the coiled wire sleeve 14 to position the insert 10 and raise and lower the insert 10 above a surface. The lifting bolt is configured to threadably connect to the inner surface of the upper portion 78. The lifting bolt has threads with a crest and root profile that compliments the shape of the inner surface of the upper portion 78, which is defined by a coiled wire. Thus, one can thread the lifting bolt into the upper portion 78 and use a hoist system that connects to the lifting bolt to lift and position the precast concrete slab. Similarly, the leveling bolt is configured to threadably connect to the inner surface of the lower portion 82, and the leveling bolt has a crest and root profile that compliments the shape of the inner surface of the lower portion 82, which is defined by a coiled wire. Therefore, one can rotate the leveling bolt through the lower portion 82 to contact the leveling bolt against the plate 26 and drive the plate 26 into the surface. As a result, the leveling bolt and insert raise the precast concrete slab above the surface.

Figure 8A:
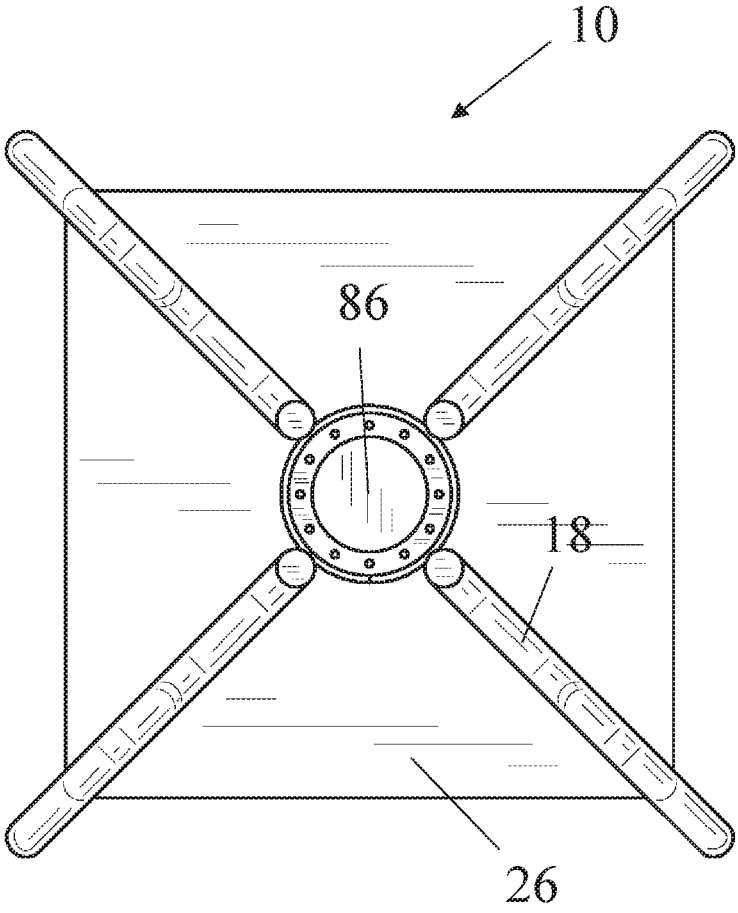
FIG. 8A is a top plan view of the insert in FIG. 6 in accordance with an embodiment of the present invention.
Figure 8B:
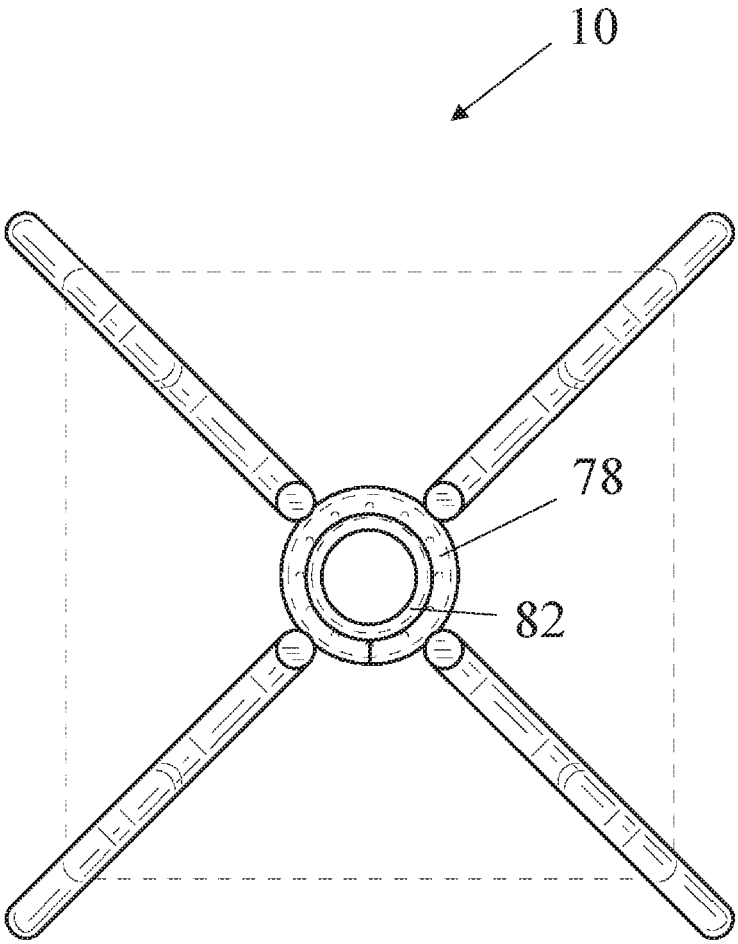
FIG. 8B is a top plan view of the insert in FIG. 6 without an upper plug in accordance with an embodiment of the present invention.
Figure 9:
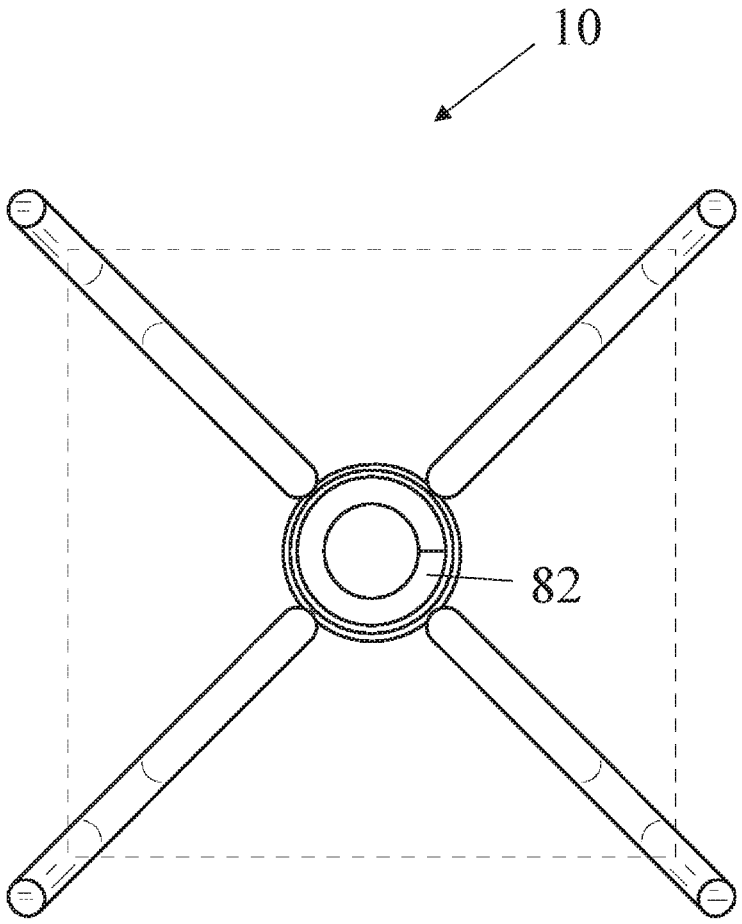
FIG. 9 is a bottom plan view of the insert in FIG. 6 without a plate or bottom plug in accordance with an embodiment of the present invention.

Now referring to FIGS. 8A, 8B, and 9, various views of the insert 10 are provided. FIG. 8A is a top plan view of the insert 10 that shows the upper plug 86 closing the interior volume of the sleeve. FIG. 8B is also a top plan view of the insert 10, but with the upper plug and plate removed so that the interior of the sleeve is visible. As depicted, the upper portion 78 has a larger inner diameter than the lower portion 82. FIG. 9 is a bottom plan view of the insert 10 with the plate and plugs removed.

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the invention. The embodiments described herein above are further intended to explain best modes of practicing the invention and to enable others skilled in the art to utilize the invention in such a manner, or include other embodiments with various modifications as required by the particular application(s) or use(s) of the invention. Thus, it is intended that the claims be construed to include alternative embodiments to the extent permitted by the prior art.

What is claimed is:

1. An insert for lifting and leveling a precast concrete slab, comprising:

a sleeve configured to be embedded in a precast concrete slab, the sleeve having a predetermined total length, said sleeve comprised of a continuous wire;

an upper thread extending along an inner surface of said sleeve by a distance that is shorter than said predetermined total length;

a lifting bolt positionable in said upper thread for hoisting and positioning said precast concrete slab, said lifting bolt having an outer diameter;

a lower thread extending along said inner surface of said sleeve by a distance that is shorter than said predetermined total length;

a leveling bolt positionable in said lower thread that is shorter than said predetermined total length of said sleeve, said leveling bolt having an outer diameter that is distinct from said outer diameter of said lifting bolt; and a plate selectively engaged to a lower end of said sleeve, wherein said plate is configured to extend away from said lower end of said sleeve as said leveling bolt rotates in said lower thread.

2. The insert of claim 1, wherein said outer diameter of said leveling bolt is smaller than said outer diameter of said lifting bolt.

3. The insert of claim 1, wherein said continuous wire has a substantially constant cross-sectional dimension along a total length of said continuous wire.

4. The insert of claim 1, wherein said sleeve has an outer diameter in an area of said upper thread that is larger than an outer diameter in an area of said lower thread.

5. The insert of claim 4, further comprising at least one leg interconnected to an outer surface of said sleeve proximate to said upper thread.

6. The insert of claim 1, wherein an inner diameter of said upper thread is greater than an inner diameter of said lower thread.

7. The insert of claim 1, further comprising a lower plug interconnected to said plate, which is configured to provide an interference fit with said lower end of said sleeve to remotely interconnect said plate to said lower end of said sleeve.

8. A method for manufacturing a first insert for lifting and leveling a precast concrete slab, comprising:

turning a continuous wire about a longitudinal axis to produce a lower portion of a first sleeve adapted for a first insert, said lower portion having an inner diameter configured to receive a leveling bolt;

turning said continuous wire about said longitudinal axis to produce a transition portion from said lower portion to an upper portion of said first sleeve;

turning said continuous wire about said longitudinal axis to produce said upper portion, said upper portion having an inner diameter configured to receive a lifting bolt, wherein said inner diameter of said lower portion is distinct from said inner diameter of said upper portion;

cutting said continuous wire after producing said upper portion; and selectively engaging a plate to said lower portion, wherein said plate is configured to disengage from said lower portion as said leveling bolt rotates through said lower portion and applies a force to said plate.

9. The method of claim 8, wherein said inner diameter of said lower portion is smaller than said inner diameter of said upper portion.

10. The method of claim 8, further comprising rotating said leveling bolt to contact said plate and disengage said plate from said lower portion.

11. The method of claim 8, wherein said continuous wire has a substantially constant cross-sectional diameter along a total length of said continuous wire.

12. The method of claim 8, further comprising:

manufacturing a second insert for lifting and leveling a precast concrete slab, subsequent to said first insert, by:

turning said continuous wire about said longitudinal axis to produce an upper portion of a second sleeve of said second insert;

turning said continuous wire about said longitudinal axis to produce a transition portion from said upper portion of said second sleeve to a lower portion of said second sleeve; and turning said continuous wire about said longitudinal axis to produce said lower portion of said second sleeve, wherein an inner diameter of said upper portion of said second sleeve is substantially the same as said inner diameter of said upper portion of said first sleeve.

13. The method of claim 12, wherein said inner diameter of said lower portion of said second sleeve is smaller than said inner diameter of said upper portion of said second sleeve.

14. The method of claim 12, wherein manufacturing of said lower portion of said first sleeve occurs prior to production of said upper portion of said first sleeve, which occurs prior to production of said upper portion of said second sleeve, which occurs prior to production of said lower portion of said second sleeve.

15. A precast concrete panel with an apparatus for lifting and leveling the precast concrete panel, comprising:

a precast concrete panel having an upper surface, a lower surface, and perimeter edges extending therebetween;

a sleeve configured to be embedded in said precast concrete panel, said sleeve having a predetermined total length and formed from a continuous wire;

an upper portion of said sleeve having an inner diameter configured to receive a lifting bolt to position said precast concrete panel, wherein an opening of said upper portion is positioned proximate to said upper surface of said precast concrete panel; and a lower portion of said sleeve having an inner diameter configured to receive a leveling bolt, said inner diameter of said lower portion is distinct from said inner diameter of said upper portion, wherein an opening of said lower portion is positioned proximate to said lower surface of said precast concrete panel.

16. The apparatus of claim 15, further comprising a plate positioned proximate to said lower portion of said sleeve, wherein rotation of said leveling bolt through said lower portion of said sleeve engages said plate positioned below said lower portion.

17. The apparatus of claim 16, further comprising a lower plug interconnected to said plate, wherein said lower plug is configured to provide an interference fit with said lower portion to provide said selective interconnection of said plate to said lower portion.

18. The apparatus of claim 15, wherein said inner diameter of said lower portion is distinct from said inner diameter of said upper portion.

19. The apparatus of claim 15, wherein said upper portion has a length less than said predetermined total length of said sleeve, and said lower portion has a length less than said predetermined total length of said sleeve.

20. The apparatus of claim 15, further comprising at least one leg interconnected to an outer surface of said upper portion of said sleeve to support said sleeve in a substantially perpendicular orientation between said upper surface and said lower surface of said precast concrete panel, and wherein each leg is made from a continuous wire, wherein said continuous wire of each leg has substantially the same cross-sectional dimension as said continuous wire of said sleeve.

* * * * *